US007107970B2

(12) United States Patent
Everingham

(10) Patent No.: US 7,107,970 B2
(45) Date of Patent: Sep. 19, 2006

(54) FUEL VAPOR PURGE CONTROL ASSEMBLY AND METHODS OF ASSEMBLING AND CONTROLLING SAME

(75) Inventor: Gary Michael Everingham, Chatham (CA)

(73) Assignee: Siemens VDO Automotive Inc., CHatham (CA)

( * ) Notice: Subject to any disclaimer, the term of this patent is extended or adjusted under 35 U.S.C. 154(b) by 0 days.

(21) Appl. No.: 10/738,254

(22) Filed: Dec. 18, 2003

(65) Prior Publication Data

US 2004/0182369 A1 Sep. 23, 2004

Related U.S. Application Data

(60) Provisional application No. 60/434,369, filed on Dec. 18, 2002.

(51) Int. Cl.
*F02M 37/04* (2006.01)

(52) U.S. Cl. ..... 123/516; 123/568.18

(58) Field of Classification Search ..... 123/520, 123/521, 518, 516, 568.17, 568.18; 251/129.11
See application file for complete search history.

(56) References Cited

U.S. PATENT DOCUMENTS 2,489,230 A 11/1949 Winkler
3,520,332 A * 7/1970 Willard ..... 137/624.13
3,741,179 A 6/1973 Vartanian
3,915,134 A 10/1975 Young et al.
4,094,285 A 6/1978 Oyama
4,171,689 A 10/1979 Eheim
4,196,708 A 4/1980 May
4,196,709 A 4/1980 Toryu et al.
4,214,562 A 7/1980 Mowbray
4,222,356 A * 9/1980 Ueda et al. ..... 123/568.18
4,230,080 A 10/1980 Stumpp
4,237,837 A * 12/1980 Toda et al. ..... 123/568.18
4,279,235 A 7/1981 Flaig et al.
4,279,473 A 7/1981 Yamana
4,280,470 A 7/1981 Ueda
4,286,567 A 9/1981 Ueda
4,295,456 A 10/1981 Nomura
4,329,965 A 5/1982 Ueda
4,364,369 A 12/1982 Nomura
4,690,119 A 9/1987 Makino et al.
4,703,738 A 11/1987 DeMinco et al.
5,234,192 A * 8/1993 Kalippke et al. ..... 251/129.11
5,305,720 A 4/1994 Ando et al.

(Continued)

FOREIGN PATENT DOCUMENTS

EP 0 840 000 5/1998

(Continued)

*Primary Examiner*—Carl S. Miller

(57) ABSTRACT

A fuel vapor purge control assembly includes an intake passage, a vapor purge passage in fluid communication with the intake passage, a port between and in fluid communication with the intake passage and the vapor purge passage; a closing member movably mounted in the intake passage and an actuator assembly received in the receptacle and connected to the closing member. The closing member has a first position where the closing member closes the port and blocks fluid communication between the intake passage and the vapor purge passage and is outside of a fluid stream of the intake passage when fluid is flowing through the intake passage. The closing member has a second position where the closing member opens the port and allows fluid communication between the intake passage and the vapor purge passage and extends into the fluid stream of the intake passage when fluid is flowing through the intake passage. The actuator assembly drives the closing member between the first and second positions.

11 Claims, 4 Drawing Sheets

U.S. PATENT DOCUMENTS 5,333,456 A 8/1994 Bollinger
5,542,711 A 8/1996 Vaudry
5,596,966 A 1/1997 Elder
5,647,399 A * 7/1997 Andersen ..... 137/637.3
5,682,863 A 11/1997 Kadooka
5,727,530 A 3/1998 Honda et al.
5,746,190 A * 5/1998 Honda ..... 123/568.18
5,785,034 A 7/1998 Moedinger et al.
5,937,834 A 8/1999 Oto
5,937,835 A 8/1999 Turner et al.
5,960,817 A * 10/1999 Johansen et al. ..... 137/202
5,996,559 A 12/1999 Busato et al.
6,102,016 A 8/2000 Sitar et al.
6,105,556 A 8/2000 Takaku et al.
6,135,415 A * 10/2000 Kloda et al. ..... 251/129.11
6,382,195 B1 5/2002 Green et al.
6,435,169 B1 8/2002 Vogt
6,494,041 B1 12/2002 Lebold
6,575,149 B1 6/2003 Gagnon
6,802,768 B1 * 10/2004 Stevenson et al. ..... 454/69
2002/0185116 A1 12/2002 Veinotte
2003/0084887 A1 5/2003 Veinotte
2003/0111066 A1 6/2003 Veinotte
2003/0116146 A1 6/2003 Fenson et al.
2004/0177838 A1 * 9/2004 Veinotte ..... 123/568.17
2004/0177839 A1 9/2004 Veinotte
2004/0255912 A1 12/2004 Veinotte et al.

FOREIGN PATENT DOCUMENTS

JP 11 294267 10/1999
JP 2000 045879 2/2000
WO WO 2002 101223 12/2002

* cited by examiner

FUEL VAPOR PURGE CONTROL ASSEMBLY AND METHODS OF ASSEMBLING AND CONTROLLING SAME

This application claims priority of copending U.S. Provisional Application No. 60/434,369 filed on Dec. 18, 2002 which is hereby incorporated by reference.

BACKGROUND OF THE INVENTION

One conventional fuel vapor purge control system for internal combustion engines relies upon a vacuum created in the intake manifold of the engine to draw fuel vapor from a canister into the engine. A purge valve opens and closes fluid communication between the canister and the intake manifold. Full throttle conditions can diminish the vacuum in the intake manifold such that the desired flow rate of fuel vapor cannot be achieved.

The purge valve can be opened and closed by an actuator mounted on the valve housing or spaced from the valve housing and connected to the purge valve by a mechanical transmission. The overall dimensions of the valve housing and the actuator (and the mechanical transmission, if used) can be larger than the preferred space available in the engine compartment or on the engine, thereby limiting the packaging options for the valve housing and the actuator. The large overall dimensions can also cause the valve housing and/or the actuator to overlap other engine components thereby obstructing or limiting access during engine maintenance.

SUMMARY OF THE INVENTION

There is provided a fuel vapor purge control assembly includes an intake passage, a vapor purge passage in fluid communication with the intake passage, a port between and in fluid communication with the intake passage and the vapor purge passage; a closing member movably mounted in the intake passage and an actuator assembly received in the receptacle and connected to the closing member. The closing member has a first position where the closing member closes the port and blocks fluid communication between the intake passage and the vapor purge passage and is outside of a fluid stream of the intake passage when fluid is flowing through the intake passage. The closing member has a second position where the closing member opens the port and allows fluid communication between the intake passage and the vapor purge passage and extends into the fluid stream of the intake passage when fluid is flowing through the intake passage. The actuator assembly drives the closing member between the first and second positions.

There is also provided method of assembling a fuel vapor purge control assembly. The vapor purge control assembly includes a flow control body and the flow control body includes a manifold conduit in fluid communication with an inlet conduit. The method includes providing a closing member having an actuator receptacle therein; inserting an actuator assembly into the actuator receptacle; and mounting the closing member inside the manifold conduit at a location adjacent the inlet conduit such that the closing member is pivotable by the actuator assembly between a first position where the closing member blocks fluid communication between the manifold conduit and the inlet conduit, and a second position where the closing member opens fluid communication between the manifold conduit and the inlet conduit.

There is yet also provided method of controlling a fuel vapor purge system. The fuel vapor purge system includes a flow control body having a manifold conduit in fluid communication with an inlet conduit, a closing member pivotally mounted in the manifold conduit to selectively open and close the fluid communication, and an actuator assembly connected to the closing member to pivot the closing member. The method includes cooling the actuator assembly with fluid flowing through the manifold conduit.

BRIEF DESCRIPTION OF THE DRAWINGS

The accompanying drawings, which are incorporated herein and constitute part of this specification, illustrate an embodiment of the invention, and, together with the general description given above and the detailed description given below, serve to explain the features of the invention.

DETAILED DESCRIPTION OF THE PREFERRED EMBODIMENTS

Figure 1:
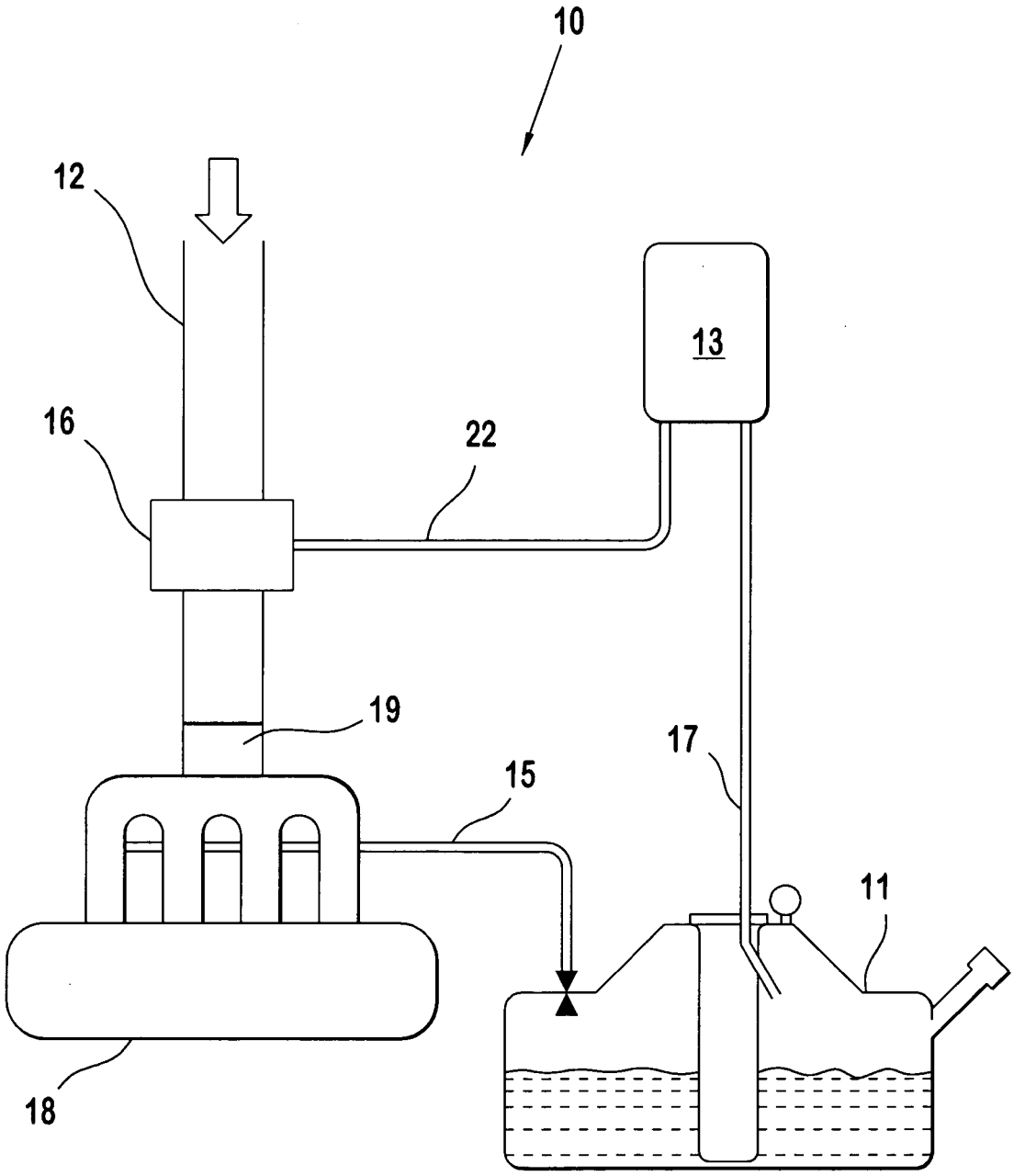
FIG. 1 is a schematic in accordance with an fuel vapor purge system for an internal combustion engine according to the present invention.

Referring to FIG. 1, a fuel vapor purge system 10 includes fuel tank 11 in fluid communication with a fuel vapor storage canister 13. The fuel vapor purge system 10 can be used to collect fuel vapor from the tank 11 and supply fuel vapor to an internal combustion engine 18 to control the emissions of fuel vapors from the fuel tank 11. Fuel vapor generated in the tank 11 passes into the fuel vapor storage canister 13 where the vapor is stored until an appropriate time for purging into the engine 18. The fuel tank 11 and the canister 13 are in fluid communication with the engine 18 by way of an intake conduit 12. The intake conduit 12 can be a manifold in fluid communication with a plurality of combustion chambers (not shown) of the engine 18. A fuel supply conduit 15 is connected between the fuel tank 11 and the intake conduit 12 to provide liquid fuel to the engine 18 for combustion.

A vapor supply conduit 17 is connected between the fuel tank 11 and the fuel vapor storage canister 13. Fuel vapor generated in the fuel tank 11 exits the tank 11 and enters the canister 13 by way of the vapor supply line 17. A vapor purge conduit 22 is in fluid communication with the fuel vapor canister 13 and the intake conduit 12. A flow control body 16 is mounted between the intake conduit 12 and the vapor purge 22 conduit to selectively open and close the fluid communication between the intake conduit 12 and the canister 13. As will be explained below, the flow control body 16 can be mounted on the intake conduit 12 either upstream or downstream of a throttle body 19, which is used to control the speed and power of the engine.

When the flow control body 16 opens communication between the canister 13 and the intake conduit 12, the fuel vapor exits the canister 13, passes through the purge conduit 22, and enters the intake conduit 12 to mix with an intake charge flowing in the intake conduit 12 on route to a combustion chamber (not shown) of the engine 18.

Figure 2:
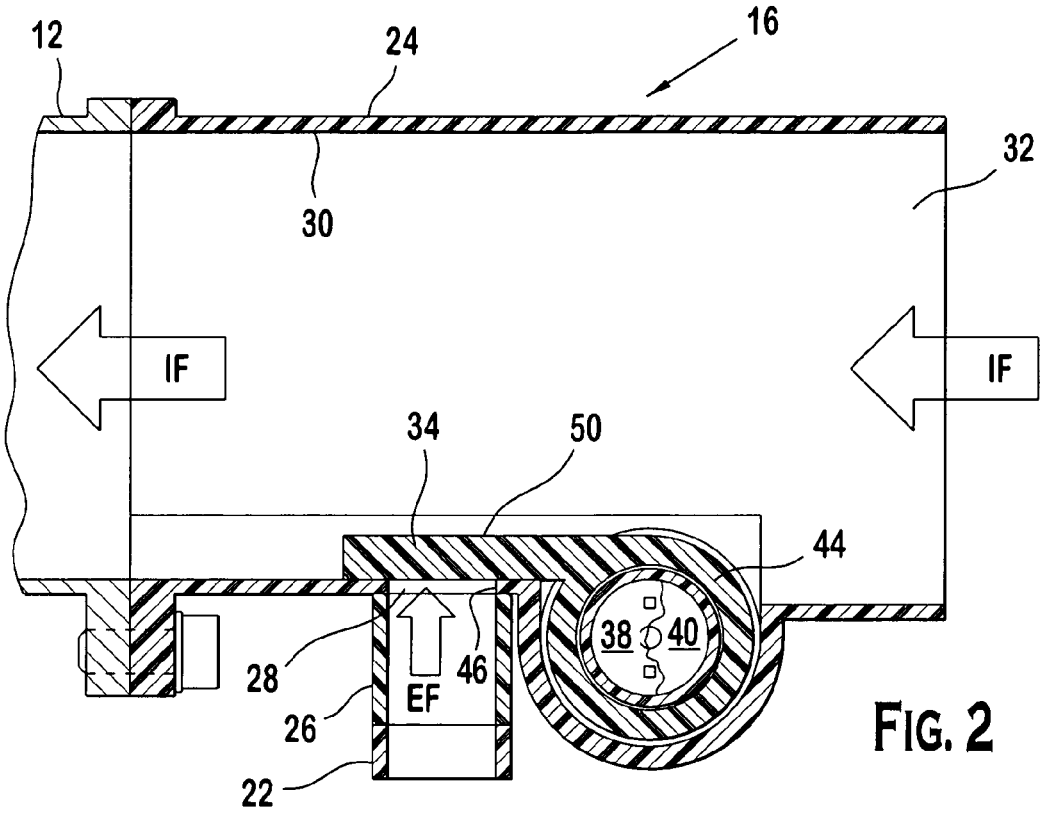
FIG. 2 is a schematic the fuel vapor purge system of FIG. 1 with a closing member in a first operating condition.
Figure 3:
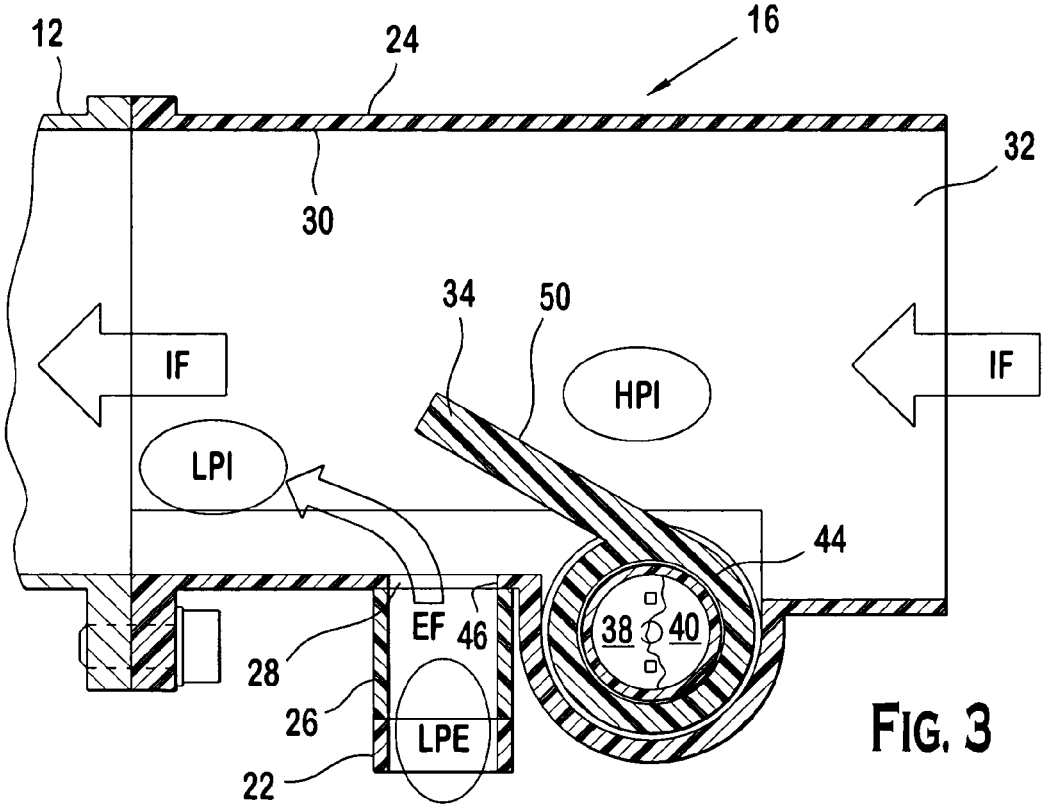
FIG. 3 is a schematic of the fuel vapor purge system of FIG. 1 with a closing member in a second operating condition.

Referring to FIGS. 2 and 3, the flow control body 16 includes a manifold conduit 24 in fluid communication with the intake conduit 12 and an inlet conduit 26 in fluid communication with the manifold conduit 24 and the vapor purge conduit 22. The manifold conduit 24 includes an opening 28 and an inner surface 30 defining a fluid passageway 32.

A closing member 34 is movably mounted in the manifold conduit 24. The closing member 34 performs two functions. First, it opens and closes the opening 28 to selectively open and close the fluid communication between the intake conduit 12 and the canister 13. Second, after the closing member 34 opens the fluid communication between the intake conduit 12 and the canister 13, the closing member 34 meters the flow rate of fuel vapor that passes from the canister 13 to the intake conduit 12.

An actuator assembly includes a servo assembly 38 drivingly coupled to the closing member 34 and a servo controller 40 electrically connected to the servo assembly 38 and a return spring (not shown) biasing the closing member 34 toward the opening 28. The spring can be connected at one end to the manifold conduit 24 and at the other end to the closing member 34. Preferably, the servo assembly 38 includes an electric motor (not shown) drivingly coupled to a gear train (not shown). The servo controller 40 generates an actuator signal and sends it to the servo assembly 38 to move the closing member 34 from the first position to the second position. Preferably, the servo controller 40 follows a closed-loop algorithm using an engine performance data input and a door position input. Alternatively, the servo controller 40 can follow an open-loop algorithm and additional inputs can be provided to the servo controller 40, such as throttle position and engine speed.

Comparing FIGS. 2 and 3, the closing member 34 is movable between a first position (FIG. 2) where the closing member 34 blocks fluid communication between the intake conduit 12 and the canister 13 and a second position (FIG. 3) where the closing member 34 opens fluid communication between the intake conduit 12 and the canister 13 and selectively meters the flow rate of fuel vapors passing into the intake conduit 12. The fuel vapor flows through the purge conduit 22 in the direction indicated by arrow EF.

FIGS. 2 and 3 schematically represent the closing member 34 as a door pivoting at one end about a rotary shaft 44. Alternatively, the closing member 34 can be displaced in a different manner between the first position and the second position, such as sliding along a linear path. The servo assembly 38 can include any suitable driving mechanism that imparts the chosen pivoting motion, linear motion or other motion on the closing member, such as, an electric or pneumatic motor with or without a gear train, or a solenoid with or without a linkage.

When in the first position, as shown in FIG. 2, the closing member 34 lies adjacent the inner surface 30 of the intake conduit 12 and engages a seat 46 surrounding the opening 28 to seal the opening 28 and block the flow of fuel vapor from the purge conduit 22 into the intake conduit 12. Preferably, the closing member 34 is positioned in the fluid passageway 32 to minimize disturbance by the closing member 34 of the fluid flowing in the fluid passageway 32 when the closing member 34 is in the first position. As shown in FIGS. 2 and 3, this can be achieved by providing a recess 48 at a location in the inner surface 30 which surrounds the opening 28. The recess 48 receives the closing member 34 so that the closing member 34 lies approximately coplanar with the inner surface 30 when the closing member 34 is in the first position. Alternatively, a ramp can be provided on the inner surface 30 that diverts the fluid flowing in the fluid passageway 32 over the closing member 34.

When in the second position, as shown in FIG. 3, the closing member 34 is disengaged from the valve seat 46 to open the opening 28 and permit fluid communication between the purge conduit 22 and the intake conduit 12. In the second position, the closing member 34 extends away from purge conduit 22 and extends into the fluid passageway 32 to affect the fluid flowing in the intake conduit 12. By extending into the fluid passageway 32, the closing member 22 creates a high pressure region HPI in the intake passage 12 that is upstream of the opening 28 and an intake low pressure region LPI in the intake conduit 12 that is downstream of and adjacent to the recirculation opening 28. The closing member 34 can vary the pressure value of the intake low pressure region LPI by the amount to which it extends into the fluid passageway 32 such that the pressure differential between the canister 13 and the intake conduit 12 is sufficient to draw fuel vapor into the intake conduit 12 for all throttle positions. As will be explained below, by varying the pressure value of the intake low pressure region LPI, the closing member 34 can meter the volume of fuel vapor entering the intake conduit 12 from the purge conduit 22.

During the intake cycle of the engine, the purge conduit 22 has a low pressure region LPE that is approximately equal to ambient atmospheric pressure. The closing member 34 further includes an operative surface 50 that causes the fluid flowing in the fluid passageway 32 to separate from a portion of the inner surface 30 adjacent the opening 28. This separation creates the intake low pressure region LPI. When the closing member 34 initially extends into the fluid passageway 32 (e.g., 10 degrees relative to a plane containing the opening), partial separation of the fluid occurs and the value of the intake low pressure region LPI is less than a maximum value. When the closing member 34 extends far enough into the fluid passageway 32 to cause full separation (e.g., 35 degrees relative to a plane containing the opening), then the value of the intake low pressure region LPI reaches a maximum value. The extent to which of the operative surface 50 reaches into the fluid passageway 32 controls the value of the intake low pressure region LPI and, thus, the pressure differential between the purge low pressure region LPE and the intake low pressure region LPI during the intake cycle of the engine 18. The operative surface 50 can be positioned in the fluid passageway such that the pressure differential is sufficient to draw fuel vapor into the intake conduit 12 even when the throttle body 19 is in a full open condition.

Because the flow control body 16, not the throttle body 19, creates the pressure differential for drawing fuel vapor from the canister 13 into the intake conduit 12, the flow control body 16 can be mounted along the intake conduit 12 at a position either upstream or downstream from the throttle body 19. This feature of the flow control body 16 can remove restraints on packaging because the flow control body 16 can be position anywhere along the intake conduit 12 where space permits.

The operative surface 50 is, preferably, configured in a shape different than the boundary shape of the inner surface 30 of the fluid passageway 32 to provide an adequate value for the intake low pressure region LPI and to promote mixing of the fuel vapor from the canister 13 with the fluid flowing in the fluid passageway 32. Preferably, the fuel vapor is mixed with the fluid flowing in the fluid passageway 32 so that each combustion chamber (not shown) of the engine 18 receives at least some of the fuel vapor passing through the opening 28. The selected geometry must balance the force generation capacity of the actuator assembly 38, 40 and the effect the operative surface 50 has on flow restriction in the intake conduit 12. The actuator assembly 38, 40 should be of a configuration capable of generating sufficient force to move the closing member 34 between the first position and second position against the resistance created by the fluid flowing in the fluid passageway 32 against the operative surface 50 of the closing member 34, while simultaneously requiring a minimum packaging volume. It is preferred that the restriction of the fluid passageway 32 by the closing member 34 minimally affect the fluid flowing through the fluid passageway 32 to the combustion chamber during the intake cycle and, thus, the power production of the engine 18.

The geometry of the operative surface 50 and relationship between the angle of the closing member 34 and the amount of fuel vapor that enters the fluid passageway 32 are from a fluid dynamics standpoint generally analogous to the control of exhaust gas entering the intake conduit as described in a U.S. patent application Ser. No. 10/290,497, filed on Nov. 8, 2002, entitled "Apparatus and Method for Exhaust Gas Flow Management of an Exhaust Gas Recirculation System", which application is hereby incorporated by reference.

The pressure of the fluid flowing in the intake conduit 12 is approximately equal to ambient atmospheric pressure if the engine is a normally aspirated engine and is greater than ambient atmospheric pressure if the engine is a turbocharged engine. As the closing member 34 moves away from the vapor purge conduit 22 and toward the second position (FIG. 3), the intake low pressure region LPI is created adjacent the opening 28 and has a value slightly less than that of the pressure of the fluid flowing in the intake conduit 12. As the closing member 34 moves farther into the fluid passageway toward the second position, the value of the intake low pressure region LPI approaches a pressure value lower than both of LPE and HP 1. The pressure differential between the intake low pressure region LPI in the intake conduit 12 and the purge low pressure region LPE in the vapor purge conduit 22 draws fuel vapor from the canister 13 into the intake conduit 12 through the opening 28. The amount of fuel vapor that enters the intake conduit 12 is proportional to the pressure differential between the intake low pressure region LPI and the purge low pressure region LPE. The pressure value of the purge low pressure region LPE remains relatively steady over time. Thus, a change in the flow rate of fuel vapor in the intake conduit 12 can be varied by varying the pressure value of the intake low pressure region LPI.

The extent to which of the closing member 34 reaches into the fluid passageway controls the value of the intake low pressure region LPI and, thus, the pressure differential between the intake low pressure region LPI and the purge low pressure region LPE during the intake cycle of the engine. When the closing member 34 first opens, the closing member 34 reaches into the fluid passageway 32 by a small amount and the intake low pressure region LPI has a value only slightly less than that of the purge low pressure region LPE. Accordingly, the pressure differential is small and the flow rate of fuel vapor through the opening 28 and into the intake conduit 12 is correspondingly small. The pressure value of the intake low pressure region LPI, and thus the pressure difference and flow rate of fuel vapor passing through the opening 28, increases as the closing member 34 reaches farther into the fluid passageway 32 of the manifold conduit 24. Therefore, closing member 34 opens fluid communication between the intake conduit 12 and the canister 13 and the closing member 34 also meters the amount of fuel vapor passing into the intake conduit 12.

Additionally, for a given position of the closing member 34 where the closing member reaches into the fluid passageway 32, the flow rate of the fuel vapor is generally directly proportional to the flow rate of the fluid in the intake conduit 12. That is, the throttle body 19 can be used to vary the amount of fuel vapor purged from the canister 13, after the closing member 34 is placed in an open position. Therefore, the closing member 34 can be designed with a maximum of two positions—opened and closed—and the normal operation of the throttle body 19 can be used to vary the flow rate of fuel vapor purged from the canister.

Figure 4:
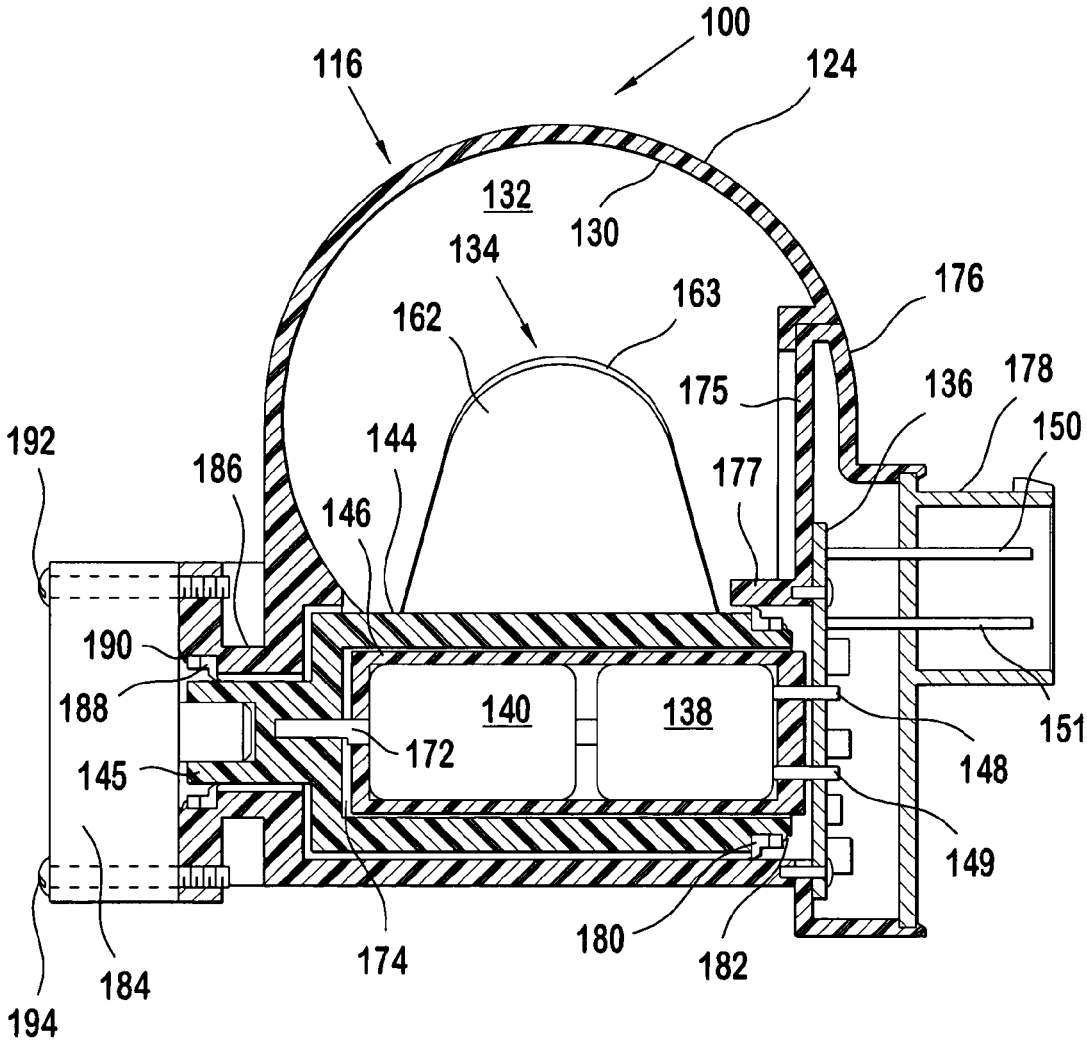
FIG. 4 is a cross-sectional view of an embodiment of a flow control body for an fuel vapor purge system according to the invention.
Figure 5:
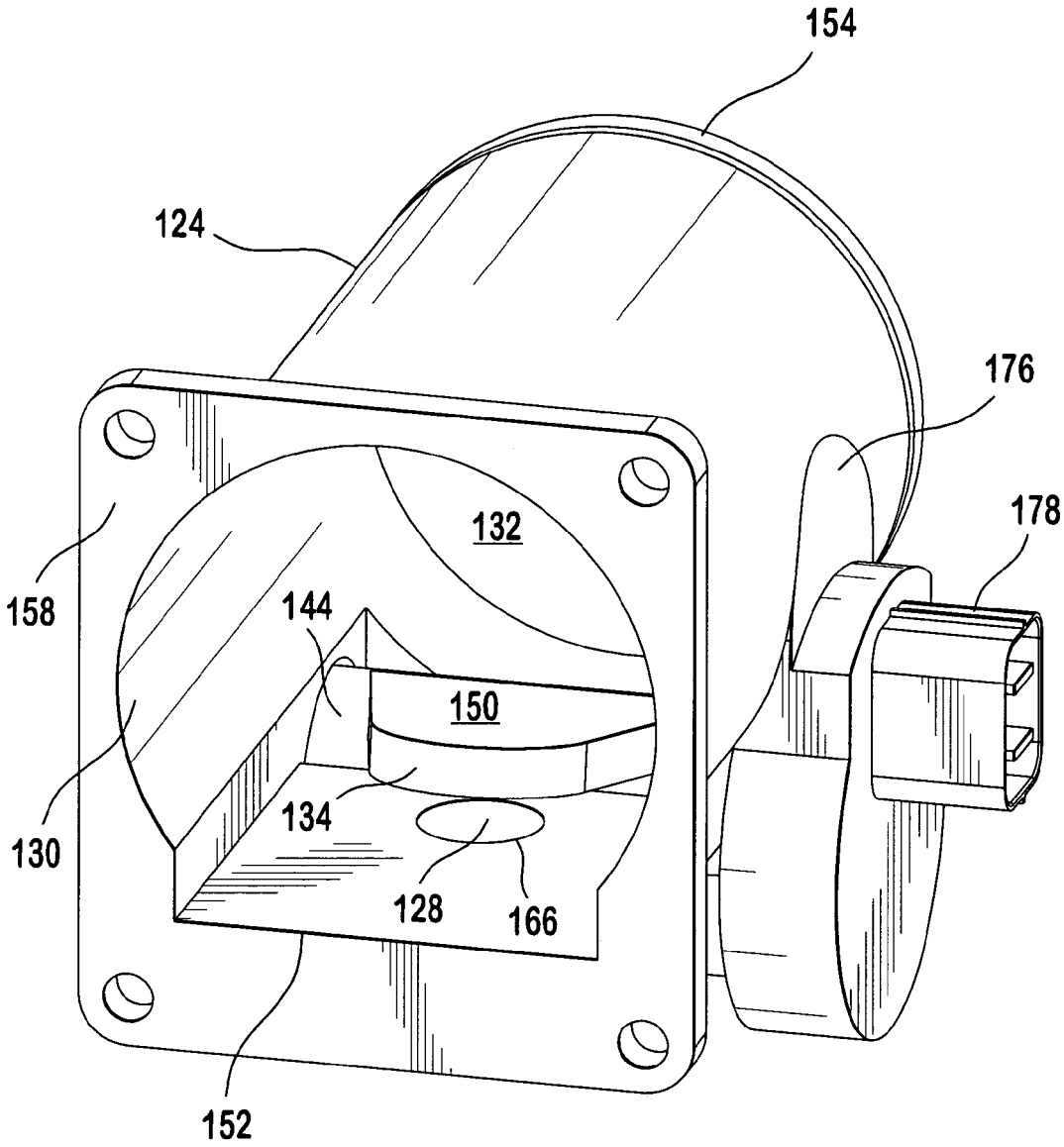
FIG. 5 is a perspective view of the flow control body according to FIG. 4.

FIGS. 4–5 illustrate an embodiment of a modular purge control assembly 100 according to the fuel vapor purge system 10 schematically represented in FIGS. 1–3. The modular purge control assembly 100 integrates a flow control body 116, a closing member 134, and an actuator assembly 136, 138, 140, 146, 184 into a modular unit. The modular purge control assembly can be configured as a single component for assembly with the engine. This can reduce the part count for the engine. The modular purge control assembly 100 is assembled to the engine by connecting the modular purge control assembly 100 to each of the intake conduit and the purge conduit so that the number of assembly steps can be minimized because the number of components for assembly is reduced.

The flow control body 116 includes a manifold conduit 124 and an inlet conduit 126 in fluid communication with the manifold conduit 124. As described above with reference to FIGS. 1–3, the manifold conduit 124 can be placed in fluid communication with an intake conduit and the inlet conduit 126 can be placed in fluid communication with a purge conduit and a canister.

The manifold conduit 124 includes a opening or port 128 (FIG. 5) and an inner surface 130 defining a fluid passageway 132. As shown in FIG. 5, the opening 128 is in fluid communication with the inlet conduit 126. The inner surface 130 extends from a first open end 152 to a second open end 154. As shown in FIG. 5, the first open end 152 includes generally circular cross-sectional shape. FIGS. 4 and 5 show the second open end 154 to include a generally circular cross-sectional shape.

Referring to FIG. 5, the inlet conduit 126 extends at an angle to the manifold conduit 124 from the opening 128 to a third open end 156. The inlet conduit 126 can extend perpendicularly from the manifold conduit, as shown in FIG. 4. The inlet conduit 126 can have a generally circular cross-sectional shape.

The closing member 134 is movably mounted in the manifold conduit 124 between a first position (e.g., FIG. 2) where the closing member 134 seals the opening 128 and blocks fluid communication between the intake conduit and the canister (e.g., 12 and 13 of FIGS. 1–3) and a second position where the closing member 134 opens the opening 128 and permits fluid communication between the intake conduit and the canister and selectively meters the flow rate fuel vapor passing into the intake conduit. FIGS. 4 and 5 show the closing member 134 in the second position represented schematically in FIG. 3.

Referring to FIGS. 4 and 5, the closing member 134 can include a flapper door 162, a seal (not shown) on the flapper door 162, and a hinge portion 144 pivotally coupling the flapper door 162 to the flow control body 116. The flapper door 162 has polygonal shape and is fixed to the hinge portion 144. A cylindrical projection (not shown) can extend from flapper door 162 adjacent the end 163. The seal can be mounted about the periphery of a cylindrical projection.

Referring to FIG. 5, when the flapper door 162 is in the first position, the cylindrical projection 170 extends through the opening 128 and the seal engages the seat 166 to block the opening 128 and close fluid communication between the intake conduit and the canister (e.g., FIG. 2). The flapper door 162 pivots by rotation of the hinge portion 144 to the second position such that the flapper door 162 extends away from the opening 128 and into the fluid passageway 132.

Referring to FIG. 4, the actuator assembly includes a servo assembly 138, 140 drivingly coupled to the closing member 134 and a servo controller 136 electrically connected to the servo assembly 138, 140 by motor terminals 148, 149. The servo controller 136 can include a printed circuit board (PCB) having circuitry and electrical power terminals 150, 151 electrically connected to the circuitry. The motor terminals 148, 149 extend through apertures (not numbered) in the PCB and cooperate with the PCB to locate the servo assembly relative 138, 140 to the servo controller 136.

Preferably, the servo assembly 138, 140 includes a d.c. motor 138 driving a gear train 140. The gear train 140 is coupled to a rotary shaft 172 to rotate the rotary shaft 172. The rotary shaft is coupled to the hinge portion 144 to rotate the hinge portion 144. Alternatively, the servo assembly 138, 140 can include other driving arrangements, such as, an electric torque motor with or without a gear train, a pneumatic actuator, a hydraulic actuator, or a solenoid with or without a linkage.

The servo controller generates 136 an actuator signal and sends it to the servo assembly 138 to move the closing member 134 from the first position to the second position. Preferably, the servo controller follows a closed-loop algorithm using an engine performance data input and a door position input. Alternatively, the servo controller can follow an open-loop algorithm and additional inputs can be provided to the servo controller, such as throttle position and engine speed.

A servo housing 146 contains the servo assembly 138, 140 and is fixed to and extends from one side the of the servo controller 136 to close one end of the servo housing 146. The rotary shaft 172 extends through the opposite end of the servo housing 146 and is fixed to the closed end of the hinge portion 144 of the closing member 134. The rotary shaft 172 can include a shaft having a D-shaped cross-section to rotationally lock the shaft 172 relative to the hinge portion 144. Alternatively, the shaft could be rotationally locked to the hinge portion by a friction fit, key assembly, splines, welding, etc.

The hinge portion 144 of the closing member 134 can include an actuator receptacle 174 that is open at one end of the hinge portion and closed at the other end of the hinge portion. The servo housing 146 can be received in the actuator receptacle 174 by inserting the servo housing 146 through the open end of the actuator receptacle 174. The outer cylindrical surface of the servo housing 146 can rotationally support the inner cylindrical surface of the actuator receptacle 174 so that the servo assembly 138, 140 can drive the hinge portion 144 to rotate about the outer surface of the servo housing 146. The servo housing 146 fully supports the hinge portion 144 such that it is unnecessary to provide bearing mounts or bearing in the manifold conduit 124 in the areas adjacent the ends of the hinge portion 144.

The manifold conduit 124 can include an assembly opening (not numbered) in a side of the manifold conduit 124 at a position intermediate the first open end 152 and the second open end 154. The assembly opening can permit the closing member 134 and the actuator assembly 136, 138, 140 to be assembled with into the manifold conduit 124 as a subassembly.

The servo controller 136 can be connected to a mounting plate 175, by a snap-fit, heat staking, welding, adhesive, or fasteners. The mounting plate 175 can be received in the assembly opening and connected to the manifold conduit 124 by a weld joint, adhesive or fasteners. The mounting plate 175 can extend across the assembly opening to cover at least a portion of the assembly opening.

An actuator cover 176 can extend over the assembly opening, the mounting plate 175, and servo controller 136 and can be connected to the manifold conduit 124 and/or the mounting plate 175 to enclose the actuator assembly 136, 138, 140. The actuator cover 176 can be connected to the manifold conduit 124 and/or the mounting plate 175 by a weld joint, adhesive or fasteners. The actuator cover 176 can include an electrical receptacle housing 178 electrically extending about the electrical power terminals 150, 151. The electrical receptacle housing 178 can protect the terminals 150, 151 from inadvertent damage and guide the mating connector during insertion onto the terminals 150, 151.

Referring to FIG. 5, the mounting plate 175 can include a flange 177 that extends across a portion of the hinge portion 144 and can be concentrically spaced from the hinge portion 144. A first seal 180 can be mounted on a first shoulder 182 formed on the cylindrical portion 144 adjacent the open end of the cylindrical portion 144. The first seal 180 can be fixed on the first shoulder 182 by heat staking, friction fit, or a snap ring. The first seal 182 can engage the inner surface of the flange 177 to seal the actuator assembly 136, 138, 140 from the fluid flowing through the fluid passageway 132.

Referring to FIG. 4, a position sensor 184 can be mechanically connected to the hinge portion 144 and electrically connected to the servo controller 136 so that the servo controller can determine the relative position of the closing member 134 in the fluid passageway 132. The position sensor 184 can be connected to a projection 145 extending from the closed end of the hinge portion 144 and through a hollow flanged extension 186 formed on the fluid conduit 124. Fasteners 192, 194 can connect the position sensor 184 to the extension 186. A second seal 188 can be mounted on a second shoulder 190 formed adjacent the end of the projection 145 that is spaced from the cylindrical portion 144. The second seal 188 can be fixed on the second shoulder 190 by heat staking, friction fit, or a snap ring. The second seal 188 can engage the inner surface of the extension 186 to seal the position sensor 184 from the fluid flowing through the fluid passageway 132.

Instead of the position sensor 184, a position sensor can be mounted on the servo controller 136. In this arrangement the projection 145, the extensions 186 and the second seal 188 can be eliminated.

The modular purge control assembly 100 can achieve a simple, visual appearance. At least the servo assembly 138, 140 can be substantially enclosed within the fluid passageway 132 of the flow control body 116. The servo assembly 138, 140 can be positioned in the path of the fluid flowing through the fluid passageway 132 such that heat from the servo assembly 138, 140 can be transferred to the fluid by convection. Thus, a substantial portion of the outer surface of the flow control body can have a mostly smooth appearance. Locating the position sensor on the servo controller can further improve the visual appearance of the assembly 100 because the flow control body 116 could enclose the position sensor.

As shown in FIG. 5, it is preferable to locate bolt flange 158 about the perimeter of the second open end 154. The bolt flange 158 is adapted to receive bolts for securing the flow control body 116 to the intake conduit. Alternatively, other arrangements can be used to secure the flow control body 116 to the intake conduit, such as, clamps, crimped flanges, solder, and flexible conduit.

While the present invention has been disclosed with reference to certain embodiments, numerous modifications, alterations and changes to the described embodiments are possible without departing from the sphere and scope of the present invention, as defined in the appended claims. Accordingly, it is intended that the present invention not be limited to the described embodiments, but that it has the full scope defined by the language of the following claims, and equivalents thereof.

I claim:

1. A fuel vapor purge control assembly comprising;

an intake passage;

vapor purge passage in fluid communication with the intake passage;

a port between and in fluid communication with the intake passage and the vapor purge, passage;

a closing member movably mounted in the intake passage and having:

a first position where the closing member closes the port and blocks fluid communication between the intake passage and the vapor purge passage and is outside of a fluid stream of the intake passage when fluid is flowing through the intake passage;

a second position where the closing member opens the port and allows fluid communication between the intake passage and the vapor purge passage and extends into the fluid stream of the intake passage when fluid is flowing through the intake passage;

a door and;

a hinge portion rotatably mounted in the intake passage and connected to the door; and an actuator assembly received in an actuator receptacle and connected to the closing member to drive the closing member between the first and second positions, the actuator receptacle being located in the hinge portion, the actuator assembly including:

a servo assembly drivingly coupled to the door;

a servo controller electrically connected to the servo assembly and actuating the servo assembly to move the door from the first position to the second position.

2. The fuel vapor purge control assembly according to claim 1, wherein the actuator assembly further comprising a servo housing containing the servo assembly and including an outer support surface rotationally supporting an inner surface of the actuator receptacle.

3. The fuel vapor purge control assembly according to claim 2, wherein the servo housing being mounted on the servo controller.

4. The fuel vapor purge control assembly according to claim 3, wherein the servo assembly further comprising:

an electric motor electrically connected to the servo controller; and a gear transmission coupled to the electric motor and to the hinge portion.

5. The fuel vapor purge control assembly according to claim 1, further comprising:

a mounting plate connected to the intake passage, the servo assembly being connected to the mounted plate; and a cover plate connected to the intake passage and extending over the mounting plate.

6. The fuel vapor purge control assembly according to claim 5, further comprising:

an electrical receptacle extending from the cover plate; and electrical terminals extending in the electrical receptacle and being electrically connected to the servo controller.

7. The fuel vapor purge control assembly according to claim 1, wherein the servo assembly being located in the fluid steam.

8. The fuel vapor purge control assembly according to claim 7, further comprising a first seal engaging the actuator assembly and the hinge portion such that the actuator assembly is sealed from fluid flowing in the intake passage.

9. The fuel vapor purge control assembly according to claim 8, further comprising:

a projection extending from the second end of the hinge portion;

a position sensor connected to and driven by the projection when the closing member moves between the first and second positions.

10. The fuel vapor purge control assembly according to claim 9, wherein the hinge portion comprising first and second ends and an outer surface extending from the first end to the second end;

the outer surface defining a first shoulder at the first end and a second shoulder at the second end; and the first and second seals engaging the first and second shoulders, respectively.

11. The fuel vapor purge control assembly according to claim 10, further comprising a second seal engaging the actuator assembly and the hinge portion adjacent the projection such that the actuator assembly is sealed from fluid flowing in the intake passage.

* * * * *